US007284515B2

(12) United States Patent
Murata

(10) Patent No.: US 7,284,515 B2
(45) Date of Patent: Oct. 23, 2007

(54) VARIABLE VALVE APPARATUS OF INTERNAL COMBUSTION ENGINE

(75) Inventor: Shinichi Murata, Okazaki ( JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/448,679

(22) Filed: Jun. 8, 2006

(65) Prior Publication Data

US 2007/0062473 A1 Mar. 22, 2007

(30) Foreign Application Priority Data

Jun. 9, 2005 (JP) ..... 2005-169636

(51) Int. Cl.
*F01L 1/34* (2006.01)

(52) U.S. Cl. ..... 123/90.16; 123/90.39; 123/90.44; 74/569

(58) Field of Classification Search ..... 123/90.15, 123/90.16, 90.17, 90.18, 90.2, 90.39, 90.44; 74/559, 567, 569

See application file for complete search history.

(56) References Cited

U.S. PATENT DOCUMENTS 6,425,357 B2 * 7/2002 Shimizu et al. ..... 123/90.16

FOREIGN PATENT DOCUMENTS

JP 2003-239712 A 8/2003

* cited by examiner

*Primary Examiner*—Ching Chang
(74) *Attorney, Agent, or Firm*—Birch, Stewart, Kolasch & Birch, LLP

(57) ABSTRACT

In a variable valve apparatus according to the present invention, a direction of a maximum load generated during valve lift at an oscillating fulcrum of a transmission arm with respect to a control shaft and a rotating direction when the control shaft is varied from the valve lift side to the low-valve lift side are set in the same direction. Consequently, the control shaft is made to easily oscillate in the direction from the high valve lift side to the low valve lift side.

6 Claims, 14 Drawing Sheets

VARIABLE VALVE APPARATUS OF INTERNAL COMBUSTION ENGINE

BACKGROUND OF THE INVENTION

1. Field of the Invention

The present invention relates to a variable valve apparatus of an internal combustion engine, which varies the phase of an intake valve or an exhaust valve.

2. Description of the Related Art

Many reciprocating engines mounted in automobiles include a variable valve apparatus for changing the phases of an intake valve and an exhaust valve, for reasons of engine gas emission countermeasures, fuel consumption reduction and the like.

Many of such variable valve apparatuses employ a structure in which the phase of a cam formed on a camshaft is replaced with an oscillating cam in which a base circular zone and a lift zone are ranging. Specifically, a structure is employed in which an oscillating range of the oscillating cam is changed, whereby a valve opening period and a valve lift amount of the intake valve and the exhaust valve driven via a rocker arm are varied continuously.

In order to improve a pumping loss, a structure is proposed in Jpn. Pat. Appln. KOKAI Publication No. 2003-239712 in which a transmission arm is interposed between a cam and an oscillating cam, and the transmission arm is oscillatably supported by a control shaft. Specifically, the transmission arm is moved by the turning displacement of the control shaft. A contact position of transmission arm and the cam is changed by moving the transmission arm. By changing the contact position of the transmission arm and the cam, the valve characteristics, that is, a valve opening period, valve open-close timing and a valve lift volume are continuously varied.

Under this kind of variable valve apparatus, variable response suited for a vehicle operating condition is requested. Specifically, when the valve lift volume is varied from a low valve lift volume to a high valve lift volume which is greater than the low valve lift volume, under which the vehicle is accelerated. As a result, it is enough that the valve lift volume is varied corresponding to acceleration. But conversely, in many cases in which the valve lift volume is varied from a high valve lift volume to a low valve lift volume, quick response is requested.

For example, when engine brakes are applied to a vehicle which carries out high rotating operation, a throttle valve is closed while maintaining the high valve lift set by the relevant high rotating operation in an engine equipped with a variable valve apparatus. Engine braking effects are generated by a pump loss generated in such a case. In this case, engine rotation is decreased due to the pump loss. When the effects of the engine brake are cancelled, it is requested to immediately vary the valve lift from high to low.

In order to secure this kind of high response with the variable valve apparatus as shown in Jpn. Pat. Appln. KOKAI Publication No. 2003-239712, it is required to use an actuator with a large capacity for an actuator which rotatably operates the control shaft.

However, the actuator with a large capacity is large. Therefore, the size of the variable valve apparatus is increased. The weight is increased and or energy consumption tends to increase. In addition, the increased size of the actuator may give rise to problems of degraded engine mountability to vehicles or increased engine weight.

BRIEF SUMMARY OF THE INVENTION

Accordingly, it is an object of the present invention to provide a variable valve apparatus of an internal combustion engine, which requires only a small control load when a valve lift is changed from the high valve lift side to the low valve lift side.

In order to achieve the above object, the variable valve apparatus of an internal combustion engine according to the present invention has allowed a control shaft to easily rotate from the high valve lift volume side to the low valve lift side in such a manner that a direction of a maximum load generated during valve lift at an oscillating fulcrum of a transmission arm to the control shaft and a rotating direction when the control shaft is varied from the high valve lift side to the low valve lift side are set in the same direction by rotating displacement of the control shaft.

In this structure, a rotary torque which goes from the high valve lift side to the low valve lift side is exerted around the center of axle of the control shaft. As a consequence, the control shaft becomes easy to rotate in the direction to change from the high valve lift side to the low valve lift side, and only a small control load is required to vary in the same direction.

Consequently, quick variable response required when variable control is carried out from the high valve lift side to the low valve lift side can be secured. In particular, exerting the maximum load generated when the oscillating cam oscillates in the valve opening direction and the maximum load generated when the oscillating cam oscillates in the valve closing direction are used as the rotary toque which goes from the high valve lift side to the low valve lift side. Consequently, the control shaft can readily rotate from the high valve lift side to low valve lift side. Thus, stable highly variable response can be secured.

As a result, the variable response can be achieved by a small-capacity actuator, and weight reduction, compact size. Reduction of energy consumption of the variable valve apparatus can be achieved and at the same time, mountability of an internal combustion engine on vehicles can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
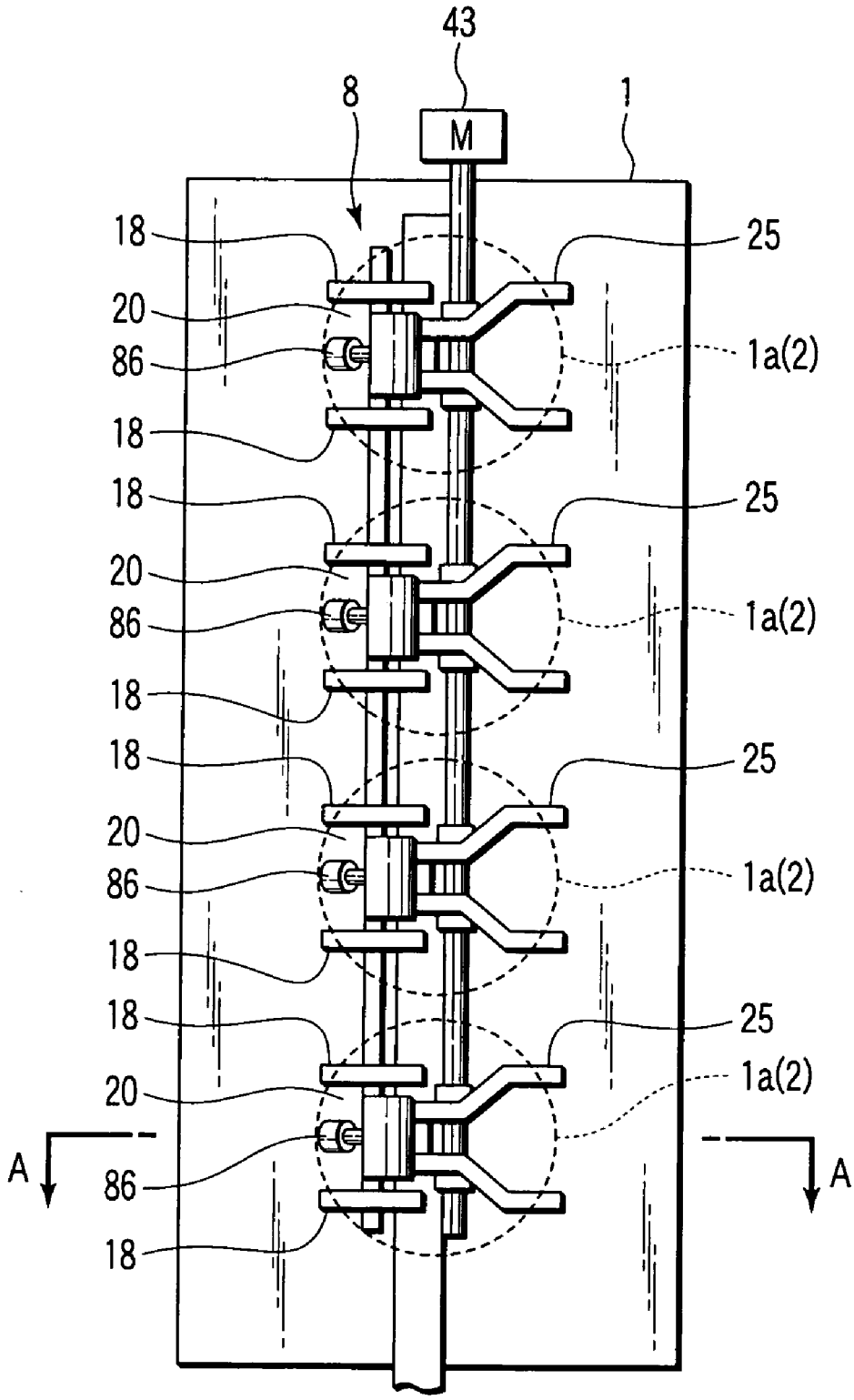
FIG. 1 is a plan view showing a cylinder head having mounted thereon a variable valve apparatus according to a first embodiment of the present invention.
Figure 2:
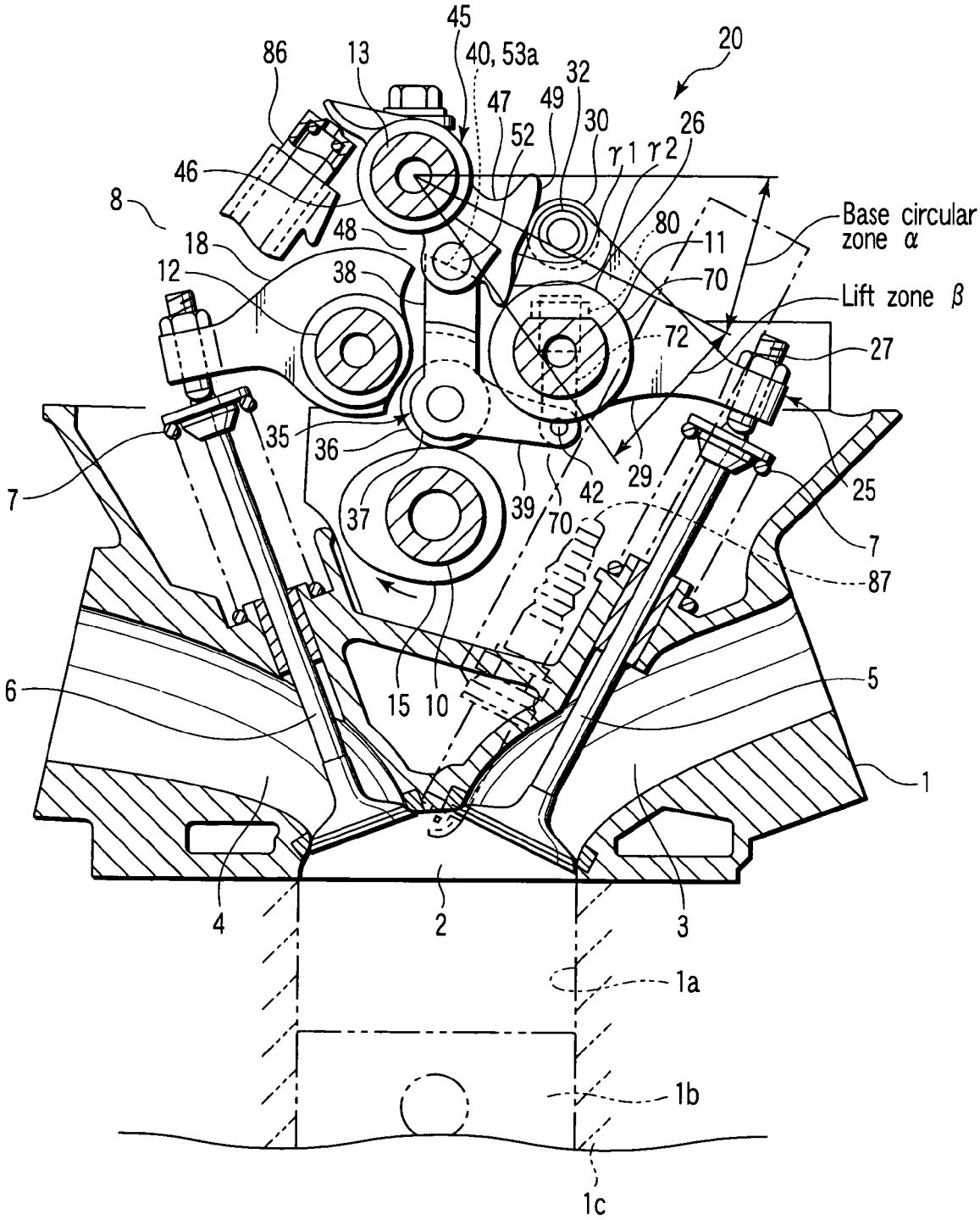
FIG. 2 is a cross sectional view showing the variable valve apparatus and the cylinder head taken along line A-A in FIG. 1.
Figure 3:
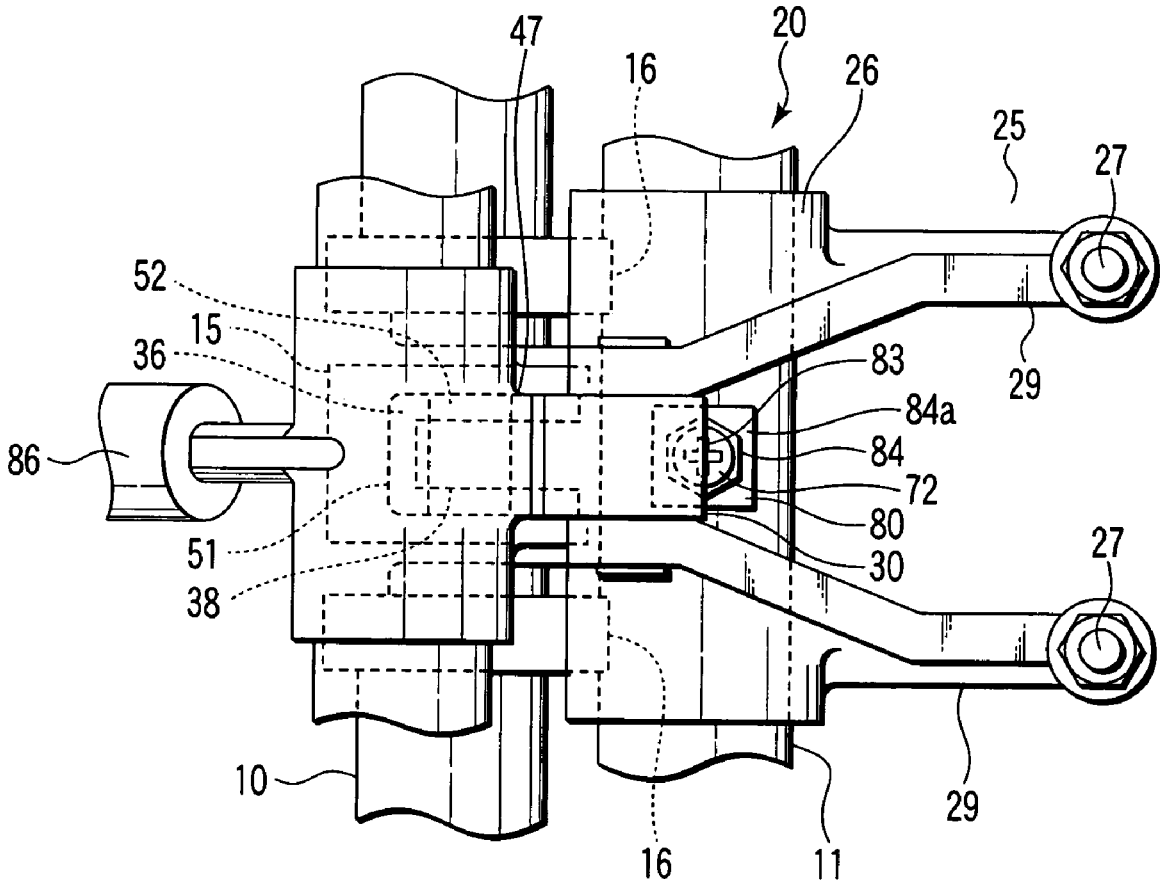
FIG. 3 is a plan view showing the variable valve apparatus shown in FIG. 2.
Figure 4:
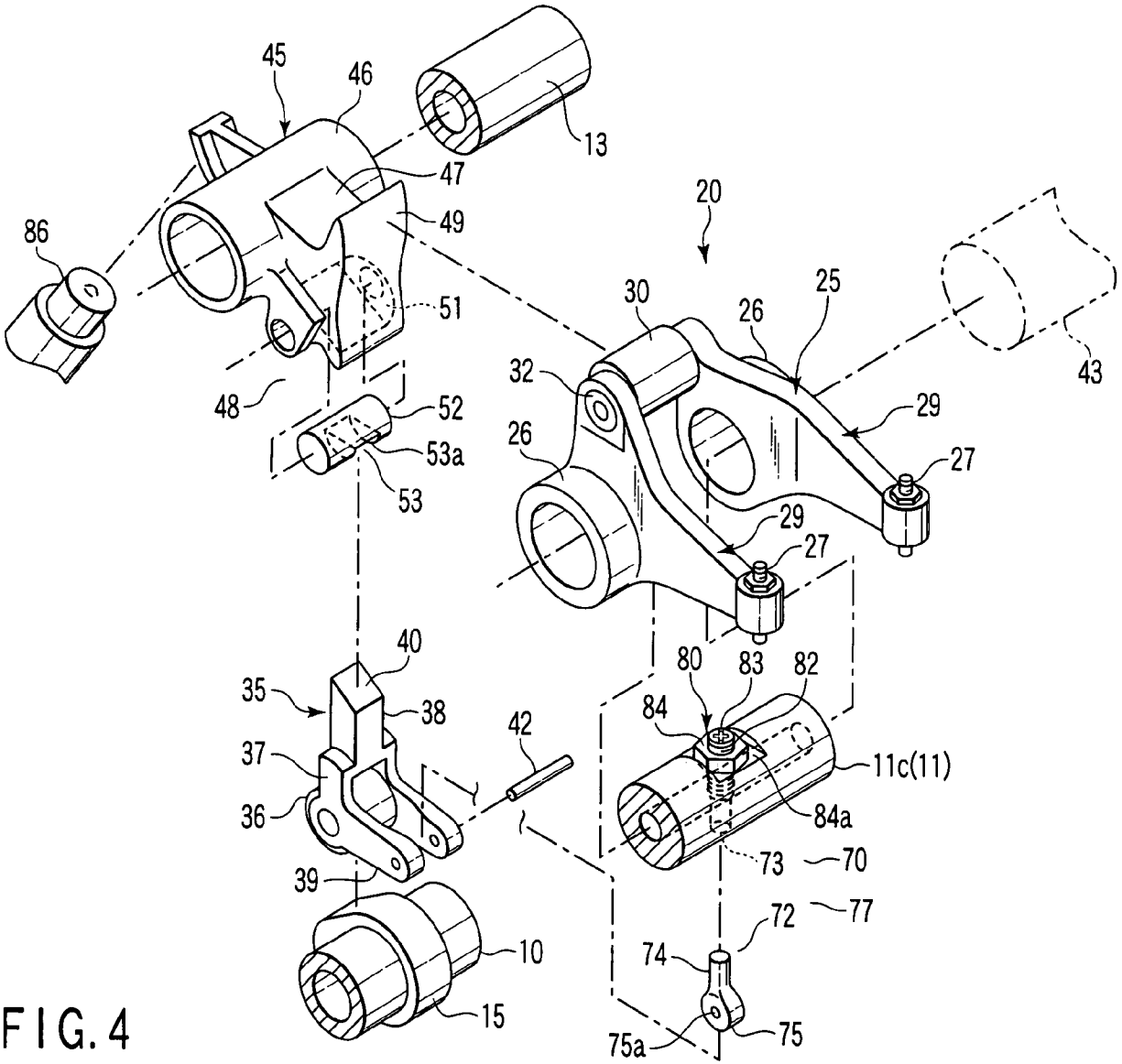
FIG. 4 is an exploded perspective view showing the variable valve apparatus shown in FIG. 2.

A variable valve apparatus according to a first embodiment of the present invention will be explained with reference to FIGS. 1 to 11 hereinafter. FIG. 1 is a plan view of a cylinder head 1 of a multi-cylinder internal combustion engine, for example, a 4-cylinder reciprocating gasoline engine 100 with cylinders 1*a* arranged in series. FIG. 2 is a detailed cross sectional view of the cylinder head 1 taken along line A-A shown in FIG. 1. FIG. 3 is a plan view showing a part of the cylinder head 1 enlarged. FIG. 4 is an exploded view of a variable valve apparatus 20 mounted on the cylinder head 1.

The cylinder head 1 will be explained with reference to FIGS. 1 to 3. On a lower surface of the cylinder head 1, combustion chambers 2 are formed, respectively, in the wake of four cylinders 1*a* formed in a cylinder block 1*c* and arranged in series. Note that combustion chamber 2 is illustrated only one in the figure.

For example, two pieces each of intake port 3 and exhaust port 4, that is, one pair of intake port 3 and exhaust port 4 are formed in the combustion chambers 2. An intake valve 5 that opens and closes the intake port 3 and an exhaust valve 6 that opens and closes the exhaust port 4 are assembled on the top of the cylinder head 1. For the intake valve 5 and the exhaust valve 6, a normally closed reciprocating valve which is energized in the closing direction by a valve spring 7 is used, respectively. Note that a piston 1*b* is reciprocatively housed in the cylinder 1*a*. The piston 1*b* is illustrated by chain two-dot, dashed line in FIG. 2.

In FIGS. 1 and 2, reference numeral 8 denotes, for example, a Single Overhead Camshaft (SOHC) type valve operating system mounted to the upper part of the cylinder head 1. The valve operating system 8 drives the intake valve 5 and exhaust valve 6.

Reference numeral 10 denotes a camshaft rotatably arranged in the longitudinal direction of the cylinder head 1 on the top of the combustion chamber 2. Reference numeral 11 denotes a rocker shaft on the intake side rotatably arranged in intake port side with which the camshaft 10 is sandwiched. The rocker shaft 11 is also used as a control shaft of the present application.

Reference numeral 12 is a rocker shaft on the exhaust side arranged and fixed on the exhaust port side. Reference numeral 13 denotes a support shaft lying above the rocker shaft 11 and 12 and located closer to the rocker shaft 12 than to the rocker shaft 11. Rocker shafts 11 and 12 and the support shaft 13 are all configured by shaft members arranged in parallel to the camshaft 10.

The camshaft 10 is rotatably driven along the arrow-mark direction of FIG. 2 by an output from a crankshaft of the engine. Note that the crankshaft is not shown. To each part of the camshaft 10, an intake cam 15 and two exhaust cams 16 are formed for each combustion chamber 2, that is, for each cylinder. The intake cam 15 is corresponding to the cam of the present invention. The intake cam 15 is arranged at the overhead center of the combustion chamber 2. The exhaust cams 16 and 16 are arranged on both sides of the intake cam 15, respectively.

To the exhaust-side rocker shaft 12, a rocker arm 18 for exhaust valve is rotatably supported for each exhaust cam 16, that is, each exhaust valve 6 as shown in FIGS. 1 and 2. In addition, to the intake side rocker shaft 11, a variable valve apparatus 20 is assembled for each pair of intake cams 15, that is, for each pair of intake valves.

The rocker arm 18 transmits displacement of the exhaust cam 16 to the exhaust valve 6. The variable valve apparatus 20 transmits displacement of the intake cam 15 to the intake valves 5 and 5. Due to the rocker arm 18 and the variable valve apparatus 20 being driven by each cam 15 and 16, predetermined combustion cycles, for example, four strokes of intake stroke, compression stroke, explosion stroke and exhaust stroke, are formed in the cylinder 1*a* in linkage with the reciprocating motion of the piston 1*b*. Note that reference numeral 87 in FIG. 2 denotes an ignition plug to ignite fuel-air mixture in the combustion chamber 2.

To explain the variable valve apparatus 20, as shown in FIGS. 1 to 4, the apparatus 20 comprise a rocker arm 25, center rocker arm 35, a swing arm 45 and a support mechanism 70. The rocker arm 25 is oscillatably supported by the rocker shaft.

The swing cam 45 is combined with the rocker arm 25. The swing cam 45 is equivalent to the oscillating cam of the present invention.

The center rocker arm 35 transmits displacement of the intake cam 15 to the swing cam 45. The center rocker arm 35 is equivalent to the transmission arm of the present invention. The support mechanism 70 oscillatably supports the center rocker arm 35 to the rocker arm 11.

As shown in FIGS. 3 and 4, the rocker arm 25 is for example bifurcate. Specifically the rocker arm 25 has a pair of rocker shaft arm pieces 29 and a roller member 30. A cylindrical rocker shaft supporting boss 26 is formed at the center of the each rocker arm piece 29. To one side of the each rocker arm piece 29, adjust screw unit 27 which drives the intake valve is assembled. The roller member 30 is sandwiched between other ends of the rocker arm pieces 29. The roller member 30 is a contact unit of the present invention. Note that reference numeral 32 denotes a short shaft to rotatably pivot the roller member 30 to the rocker arm piece 29.

The rocker shaft 11 is inserted in the bosses 26 and can oscillate. The roller member 30 is arranged on the support shaft 13 side, namely on the center side of the cylinder head 1.

The adjust screw units 27 are arranged at the upper ends of the intake valves 5, that is, valve stem end of the intake valve 5, respectively. When the rocker arm 25 oscillates around the rocker shaft 11, the intake valves 5 are driven.

As shown in FIGS. 2 to 4, the swing cam 45 has a boss portion 46, an arm portion 47, and a receiving unit 48. The boss portion 46 is cylindrical. The support shaft 13 is inserted into the boss portion and rotatably fitted. The arm portion 47 extends from the boss portion 46 to the roller member 30, that is, rocker shaft. The receiving unit 48 is formed at the lower part of the arm portion 47.

The front end surface of the arm portion 47 is a cam surface 49 which transmits displacement to the rocker arm 25. The cam surface 49 extends in the vertical direction. The cam surface 49 is brought rotatably in contact with the outer circumferential surface of the roller member 30 of the rocker arm 25. The detail of the cam surface 49 will be described later.

As shown in FIG. 4, the receiving unit 48 comprises a recessed portion 51 and a short shaft 52. The recessed portion 51 is formed at the lower surface portion of the lower part of the arm portion 47 which is directly above the camshaft 10. The short shaft 52 is rotatably supported in the recessed portion 51 in the direction same as that of the camshaft 10. Note that reference numeral 53 denotes a recessed portion which is formed on the outer circumference of the short shaft 52 portion and has a flat bottom surface.

As shown in FIGS. 2 and 4, to the center rocker arm 35, a substantially L-shape member is used. The center rocker arm 35 has a rotary contact element, for example, a cam follower 36 which comes rotatably in contact with the cam surface of the intake cam 15, and frame-shape holder unit 37 which rotatably supports the cam follower 36.

Specifically, the center rocker arm 35 has a relay arm portion 38 and a fulcrum arm portion 39. The relay arm portion 38 extends from the holder unit 37 towards between the upper rocker shaft 11 and the support shaft 13. As shown in FIGS. 5 to 8, the fulcrum arm portion 39 extends from the holder unit 37 to the bottom side of a shaft portion 11*c* of the rocker shaft 11. The shaft portion 11*c* is exposed from between the pair of rocker arm pieces 29.

The fulcrum arm portion 39 is, for example, bifurcated. To the front end, i.e. top end surface, of the relay arm portion 38, a gradient surface 40 is formed as a drive surface. The gradient surface 40 tilts in such a manner that the rocker shaft 11 side is lower and the support shaft 13 side is higher. The front end of the relay arm portion 38 is inserted into the recessed portion 53 of the swing cam 45. With this, the center rocker arm 35 is interposed between the intake cam 15 and the swing cam 45. The gradient surface 40 of the arm unit 38 is slidably abutted on a receiving surface 53*a* formed at the bottom surface of the recessed portion 53. By this, displacement of the intake cam 15 is transmitted to the swing cam 45 from the relay arm portion 38 while being accompanied by slides.

As shown in FIGS. 2 and 4, the support mechanism 70 has a support unit 77 and an adjusting unit 80. The support unit 77 has a control arm 72. The control arm 72 oscillatably supports the center rocker arm 35. The adjusting unit 80 adjust the position of the center rocker arm 35.

Now, the support unit 77 will be explained. A through hole 73 is formed on a lower peripheral wall of the shaft portion 11*c*. The through hole portion 11 extends in a direction orthogonal to the center of axle of the shaft portion 11*c*. The control arm 72 is formed to have a rod portion 74 having a circular cross section, a disk-shaped pin joining piece 75 formed on one end of the rod portion 74, and a support hole 75*a* formed on the pin joining piece 75. The support hole 75*a* is shown in FIG. 4.

The end of the shaft 74 is inserted into the through hole 73 from the bottom of the shaft portion 11*c*. Note that the inserted rod portion 74 can move in the axial direction and rotate in the circumferential direction. The end of the rod portion 74 impinges against a component of the adjusting unit 80 described later.

The pin joining piece 75 is inserted in the fulcrum arm portion 39. A pin 42 is inserted in the arm unit 39 and the support hole 75*a*, thereby allowing the front end of the fulcrum arm portion 39 and the end of the control arm 72 protruding from the shaft portion 11*c* to rotatably join each other in the protruding direction, that is, direction orthogonal to the center of axle of the camshaft 10 of the intake cam 15.

Since the fulcrum arm portion 39 and the control arm 72 are joined together, the center rocker arm 35 oscillates up and down, using the pin 42 as fulcrum, when the in the intake cam 15. In linkage with the motion of the center rocker arm 35, the swing cam 45 is periodically oscillated with the support shaft 13 used as the fulcrum, the short shaft 52 used as the point of action, that is, point at which a load from the center rocker arm 35 works on, and the cam surface 49 used as the point of force, that is, as point at which the rocker arm 25 is driven.

Note that the rocker arm 25, the center rocker arm 35, and the swing cam 45 are mutually energized by energizing means, for example, a pusher 86, in a direction to come in close contact to each other to secure smooth movement.

As shown in FIGS. 1 and 4, for example, a control motor 43 as an actuator is connected to the end of the rocker shaft 11. The rocker shaft 11 is driven, or rotated around the center of axle by the control motor 43. By this rotation of the rocker shaft 11, the control arm 72 can be varied from a substantially perpendicular posture shown in, for example, FIGS. 5 and 6 to a posture greatly tilted to the camshaft rotating direction shown in FIGS. 7 and 8.

The center rocker arm 35 is moved, that is, displaced in the direction intersecting with the axial direction of the shaft portion 11*c* from this change of posture of the control arm 72. That is, as shown in FIGS. 5 to 8, the position at which the follower rolling intake contact cam follower 36 and the intake cam 15 can be varied in the early injection directions or the late injection direction.

Because the rotary contact position is variable, the posture of the cam surface 49 of the swing cam 45 is varied too. That can simultaneously and continuously vary an opening and closing timing, a valve opening period, and a valve lift volume of the intake valve 5.

Specifically, a curvature which varies the distance from the center of, for example, the support shaft 13 is used for the cam surface 49. As shown in FIG. 2, the cam surface 49 has a base circular zone $\alpha$ and a lift zone $\beta$. The circular zone $\alpha$ is the upper side of the cam surface 49. The base circular zone α is a circular arc surface centering around the center of axle of the support shaft 13.

The lift zone β is the lower side part of the cam surface 49. The lift zone β has a first portion γ1 and a second portion γ2. The first portion γ1 extends from the base circular zone α and curves the opposite direction opposite to the direction in which base circular zone α curves. The second portion γ2 extends from the first portion γ1. The second portion γ2 curves in the opposite direction opposite to the direction in which the first portion γ1 curves. Specifically, the base lift zone β is a circular arc surface similar to a cam shape of a lift area of, for example, the intake cam 15.

The oscillating range of the swing cam 45 is varied when rotary contact position where the cam follower 36 rotary contacts the intake cam 15 is displaced in the early or late injection direction of the intake cam 15. When the oscillating range of the swing cam 45 is varied, the region of the cam surface 49 with which the roller member 30 comes in contact is varied. More specifically, it is intended that the ratio of the base circular zone α and the lift zone β where the roller member 30 comes and goes is varied while the phase of the intake cam 15 is shifted to the early injection direction or late injection direction.

To the adjusting unit 80, a structure to support the end of the inserted control arm 72 by a screw member 82 is adopted as shown in, for example, FIGS. 2 to 4. Specifically, the screw member 82 is screwed from a point that is opposite to through hole 73 in the shaft portion 11*c* in such a manner as to freely advance and retreat. That is, the screw member 82 is screwed from upper peripheral wall of the shaft portion 11*c*. The insertion end of the screw member 82 impinges against the end of the control arm 72 halfway in the passage 73 and supports the control arm 72.

As a consequence, operating to rotate the screw member 81 varies the protrusion rate of the rod portion 74 protruding from the shaft member 11*c*. The volume of the protruding portion of the rod portion 74 is varied. When the protrusion rate of the rod portion 74 is varied, the rotary contact position of the cam follower 36 with which the intake cam 15 comes in contact is varied. On the basis of the changes of the rotary contact position of the cam follower 36 with which the intake cam 15 comes in contact with, valve opening time and the valve closing time of the intake valve 5 are adjusted.

Reference numeral 83 denotes, for example, a cruciform groove formed on the top end surface of the screw member 82 to operate to rotate the screw member 82. Reference numeral 84 denotes a lock nut driven into the end of the screw member 82. Reference numeral 84*a* denotes a notch which forms a bearing surface of the lock nut 84.

With reference to FIGS. 5 to 8, discussion will be made on the operation of the variable valve apparatus 20 obtained by the configuration described above. Now, assume that the camshaft 10 is rotated by the operation of an engine as shown in the arrow mark direction of FIG. 2.

In this case, the cam follower 36 of the center rocker arm 35 contacts the intake cam 15 and is tracer-driven by the cam profile of the cam 15. By this, the center rocker arm 35 oscillates in the vertical direction with the pin 42 set as the oscillating fulcrum.

The receiving surface 53*a* of the swing cam 45 is transmitted the oscillation displacement of the center rocker arm 35 through the gradient surface 40. Now, since the receiving surface 53*a* and the gradient surface 40 are slidable, the swing cam 45 repeats oscillating movement of being pressed up or lowered by the gradient surface 40 while sliding on the gradient surface 40. Oscillation of the swing cam 45 allows the cam surface 49 to reciprocate in the vertical direction.

Because, in this case, the cam surface 49 is rotatably in contact with the roller member 30 of the rocker arm 25, the roller member 30 is periodically pressed by the cam surface 49. The rocker arm 25 oscillates when pressure is applied thereto, and opens or closes the pair of intake valves 5, with the rocker shaft 11 as a support point.

Now, assume that the engine is operated at a high speed by operation of an accelerator pedal. After the motor 43 as a actuator receives acceleration signal, the motor 43 rotates the rocker shaft 11 and rotates the control arm 72 to the spot where, for example, the maximum valve lift volume is secured, for example, where the control arm 72 achieves the vertical posture as shown in FIGS. 5 and 6.

Then, the center rocker arm 35 displaces along the rotating direction on the intake cam 15 in response to the rotation of the control arm 72. As a consequence, the position where the center rocker arm 35 comes in rotary contact with the intake cam 15 is deviated in the early or late injection direction on the intake cam 15. Therefore the cam face 49 of the swing cam 45 fixed to the position where the cam surface 49 of the swing cam 45 achieves an angle close to perpendicularity as shown in FIGS. 5 and 6.

Figure 5:
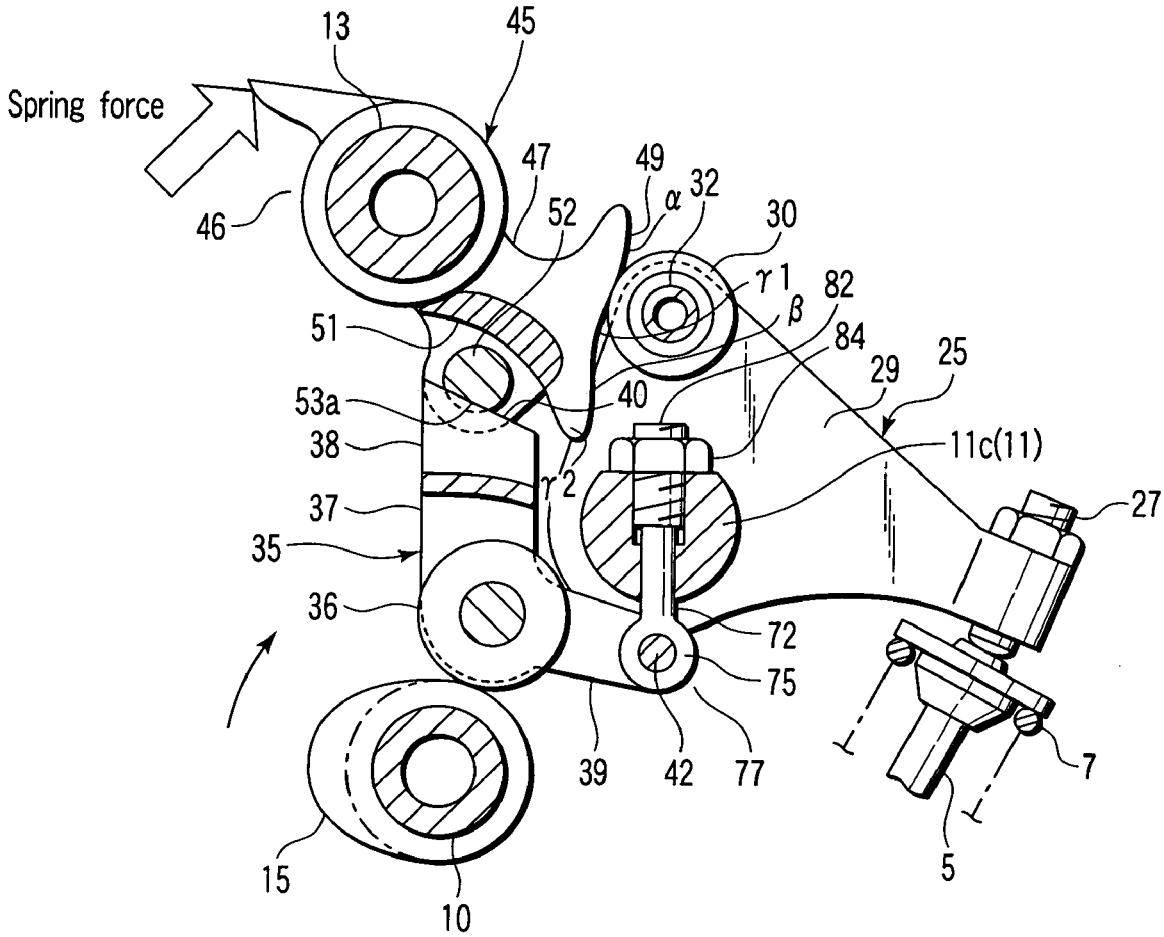
FIG. 5 is a cross sectional view showing a state where a rocker arm contacts a base circular zone of a cam surface at the maximum valve lift control of the variable valve apparatus shown in FIG. 2.
Figure 6:
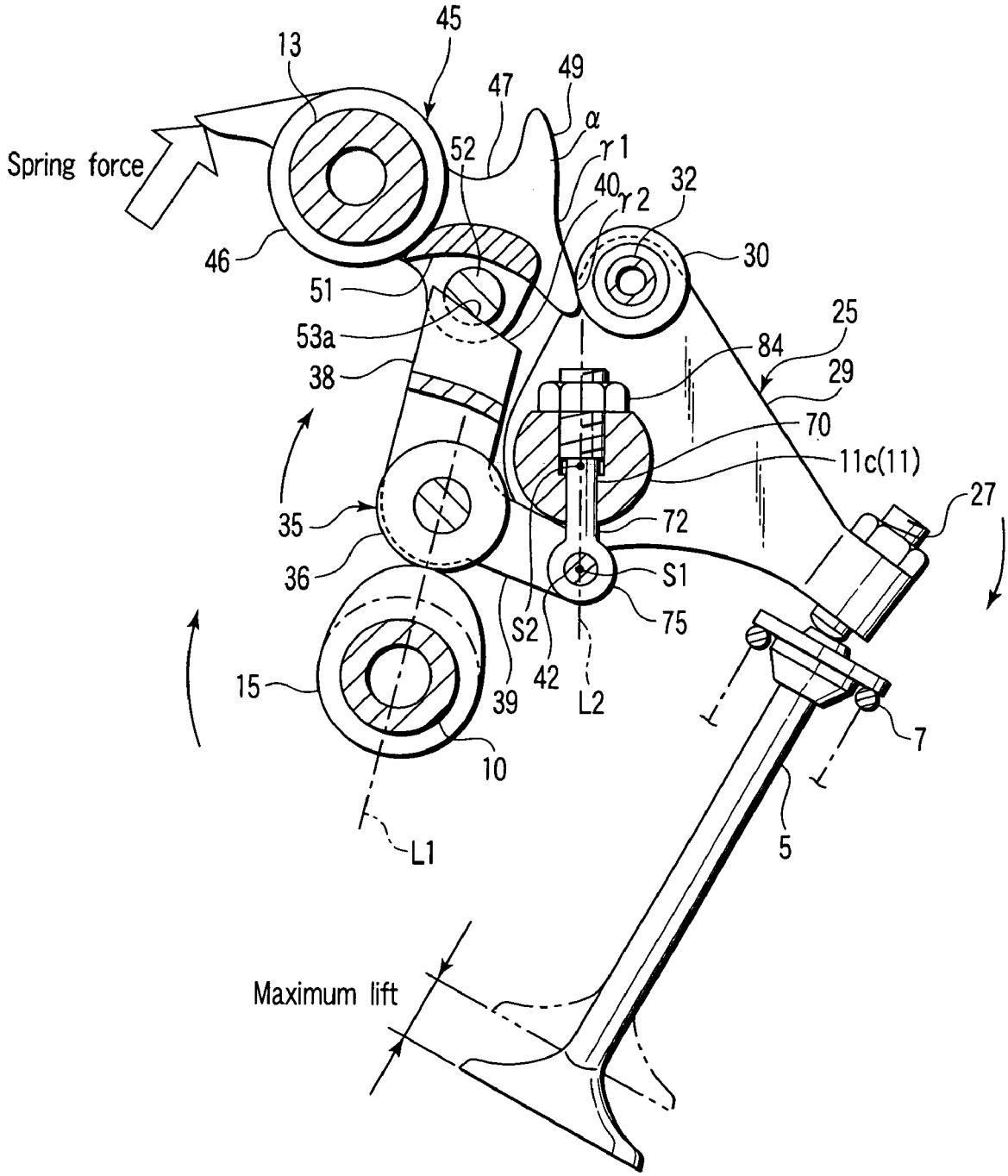
FIG. 6 is a cross sectional view of the variable valve apparatus, showing the rocker arm contacting the base circular zone also showing a valve driving force and a force working on a transmission arm in the at the maximum valve lift control.

By the posture of the cam surface 49, a region where the roller member 30 of the cam surface 49 comes and goes as shown in FIGS. 5 and 6 is set to a region which brings the maximum valve lift volume, that is, to the shortest base circular zone α and the longest lift zone β. That is, the rocker arm 25 is driven by the cam surface portion made by the narrow base circular zone α and the longest lift zone β. Consequently, the intake valve 5 is opened and closed at the maximum valve lift volume as shown in the graph of A1 of, for example, FIG. 9, and further, at an opening and closing timing that follows the intake stroke.

Figure 7:
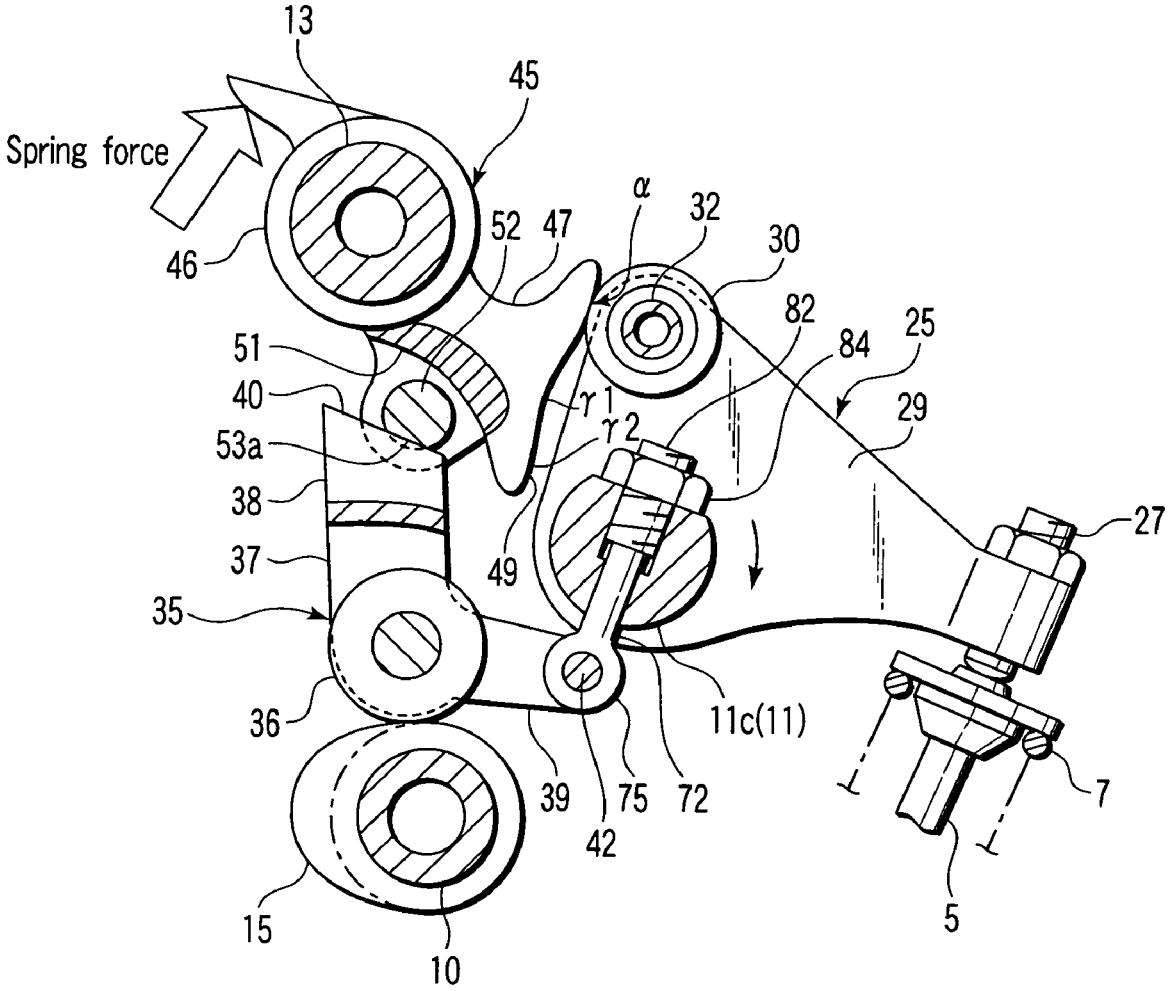
FIG. 7 is a cross sectional view showing a state where the rocker arm contacts the base circular zone of the cam surface at the minimum valve lift control of the variable valve apparatus shown in FIG. 2.
Figure 8:
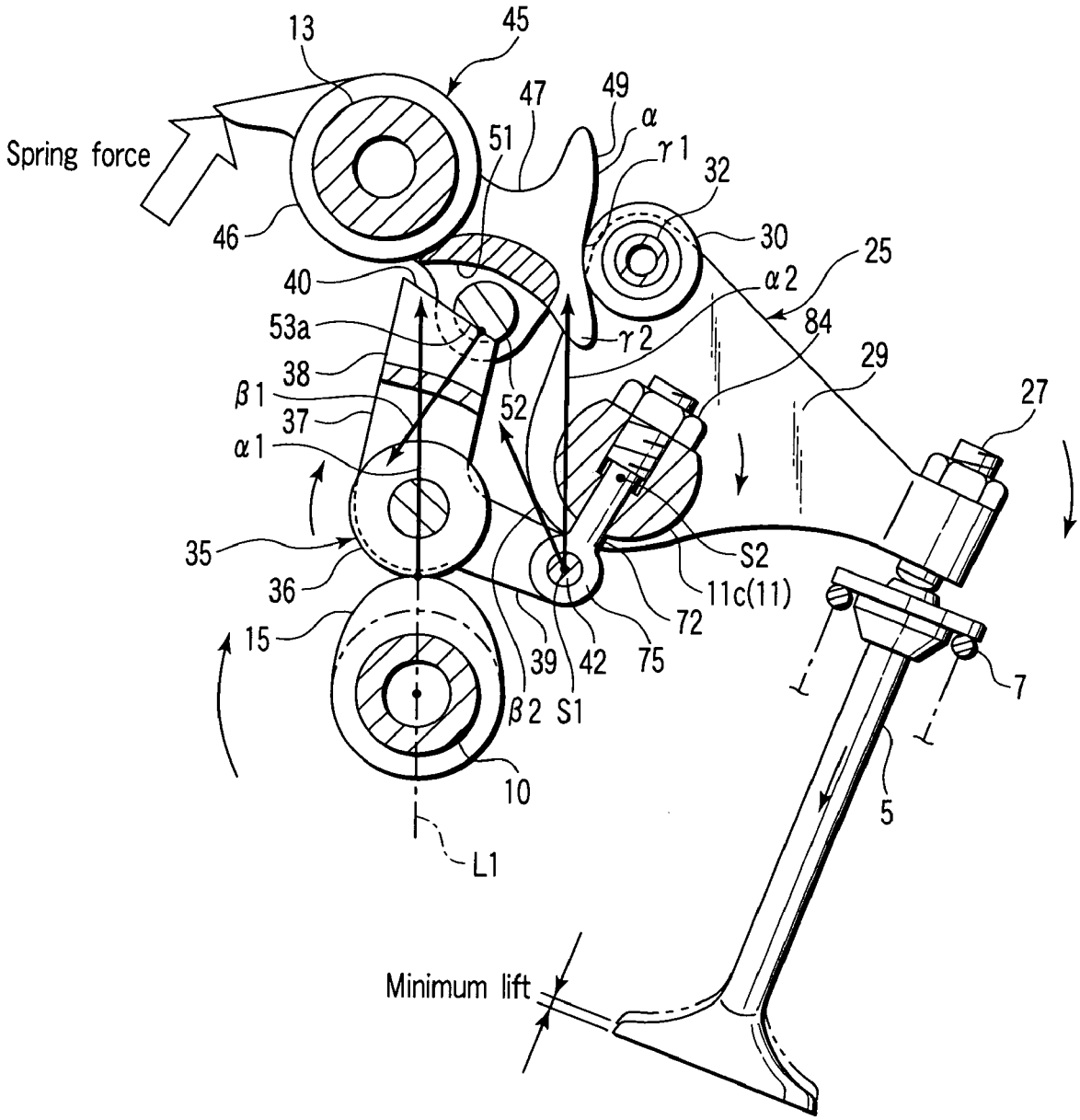
FIG. 8 is a cross sectional view showing a state where the rocker arm contacts a lift zone of the cam surface at the minimum valve lift control of the variable valve apparatus shown in FIG. 2.

In addition, when low and medium rotating operations are carried out, the drive of the control motor 43 rotates the rocker shaft 11 in the direction in which the pin 42 close to the intake cam 15 as shown in FIGS. 7 and 8. Then, in response to the rotation of the rocker shaft 11, the center rocker arm 35 moves on the intake cam 15 to the front side of the rotating direction. As a result, the rotary contact position between the center rocker arm 35 and the intake cam 15 is deviated in the early injection direction on the intake cam 15 as shown in FIGS. 7 and 8. By the change of this rotary contact position, the valve opening time of the cam phase is quickened. In addition, the gradient surface 40 slides from the initial position to the early injection direction on the receiving surface 53*a* in response to the shift of the center rocker arm 35.

By the shift of the center rocker arm 35 in this case, the swing cam 45 changes the posture to have the cam surface 49 tilted to the down side as shown in FIGS. 7 and 8. As the gradient increases, the region of the cam surface 49 in which the roller member 30 comes and goes is changed to a region in which the base circular zone α gradually increases and the lift zone β gradually decreases.

As the cam profile of the varied cam surface 49 is being transmitted to the roller member 30, the rocker arm 25 is oscillatably driven while the valve opening time is quickened.

Figure 9:
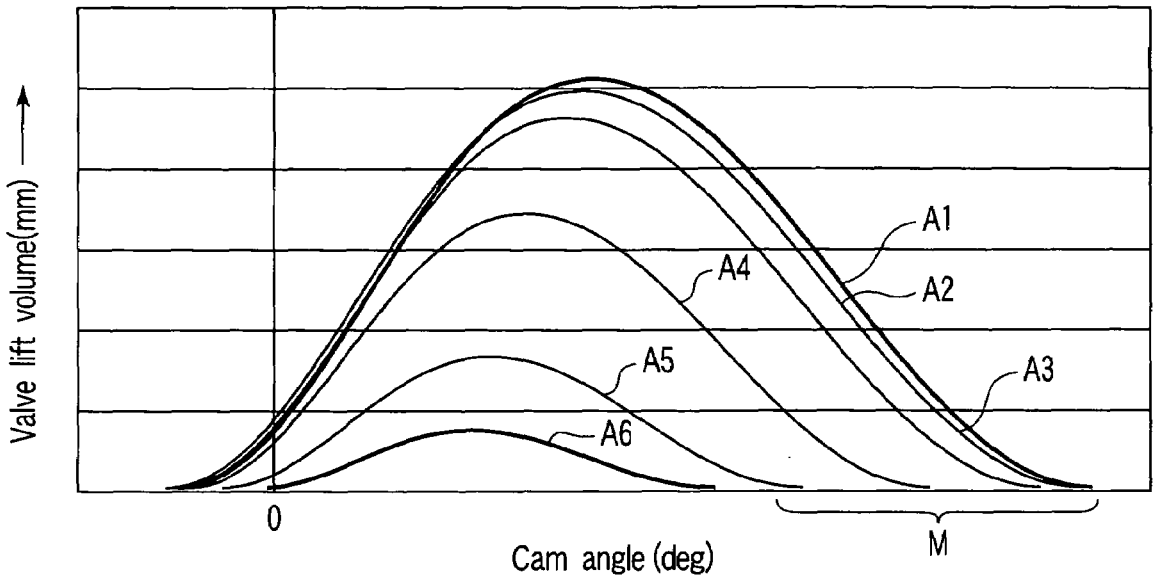
FIG. 9 is a graph showing performances of the variable valve apparatus shown in FIG. 2.

Accordingly, the intake valve 5 is controlled from the maximum valve lift volume A1 shown in, for example, FIG. 9 to the minimum valve lift volume A6 at the spot where the control arm 72 is tilted to the maximum. That is, the intake valve 5 holds the timing to open the valve substantially same at the maximum valve lift period from the high rotating operation to low rotating operation of the engine. The valve lift volume is continuously varied with varying the valve-close timing greatly while being the low valve lift volume. Needless to say, the engine 100 is 4 cylinders engine, and the rocker shaft 11, that is, control shaft is used in common among cylinders. Thus, this kind of variation of characteristics of the intake valve 5 takes place in all the cylinders 1*a*.

A contrivance is provided on the variable valve apparatus 20 which carries out this kind of variation of valve phase. The contrivance make it facilitative to rotate the rocker shaft 11 in the direction in which the rocker shaft 11 is varied from the high valve lift side to the low valve lift side when the valve characteristics are set in am intermediate valve lift region M which is between the minimum valve lift volume A6 and the maximum valve lift volume A1 as shown in, for example FIG. 9.

Note that, A state in which the valve lift volume of the variable valve apparatus 20 is the minimum valve lift volume A6 is a equivalent to the first lift sate of the present application. A state in which the valve lift volume of the variable valve apparatus 20 is the maximum valve lift volume A1 is a equivalent to the second lift sate of the present application.

This contrivance is a technique to allow the maximum load generated at the oscillating fulcrum S1 of the center rocker arm 35 in the valve lift to work on one rotating direction side with the center S2 of the rocker shaft 11 in-between, that is, towards the rotating direction from the high valve lift to the low valve lift when the valve characteristics are located in the range of the intermediate valve lift region M as shown in FIG. 8.

For this technique, a structure is adopted, in which a line L2 that connects the oscillating fulcrum S1 of the center rocker arm 35 to the center S2 of the rocker shaft 11, that is, control shaft is arranged so that the line L2 is parallel or the substantially parallel to a line L1 that connects the center of the intake cam 15 to the contact point between the intake cam 15 and the center rocker arm 35 at the time of the maximum valve lift volume as shown in, for example, FIG. 6. Note that, in the present embodiment, substantially parallel condition is adopted.

With this structure, when the valve lift is located in the range of the intermediate valve lift region M, the line L2 is deviated, that is, the line L2 is tilted with respect to the line L1. The shift displacement amount, that is, tilt amount varies in accordance with the valve characteristics set in the intermediate valve lift region M. Based on this shift, when a valve driving force $\alpha 1$ is transmitted from the intake cam 15 to the center rocker arm 35 with the valve open as shown in FIG. 8, a force $\alpha 2$ which works on the oscillating fulcrum S1 of the center rocker arm 35 is exerted on the left side with the center S2 of the rocker shaft 11 in-between, that is, in the direction around the center of axle that is headed from the high valve lift volume to the low valve lift volume of the rocker shaft 11.

In addition, when the center rocker arm 35 is oscillated by a force $\beta 1$ from the pusher 45 or valve spring 7 with the valve closed, a force $\beta 2$ exerted to the oscillating fulcrum S1 of the center rocker arm 35 is also intended to work on the direction around the center of axle that is headed from the high valve lift volume to the low valve lift volume of the rocker shaft 11.

That is, the maximum load $\alpha 2$ or the maximum load $\beta 2$ generated at the oscillating fulcrum S1 during valve lift in the intermediate valve lift region M is allowed to be exerted constantly on one side around the center of axle of the rocker shaft 11, that is, on the direction around the center of axle which is headed from the high valve lift volume to the low valve lift volume. Consequently, the direction in which the rocker shaft 11 rolled during the valve characteristic being varied from high valve lift volume to the low valve lift volume and the direction in which the maximum load generated at the oscillating fulcrum S1 during lift is exerted on the rocker shaft 11 are set in the same direction.

That is, by this setting, the rotary torque is applied on the rocker shaft 11 in the same direction as those of the rocker shaft 11 during the valve characteristics being varied from the high valve lift to the low valve lift. Thereby, the rocker shaft 11 can readily rotate when the valve characteristics are varied from the high valve lift volume to the low valve lift volume.

In particular, in order to enable the rocker shaft 1 to rotate easily, each rotating direction around the center S2 of the rocker shaft, which is generated by the maximum load working on the oscillating fulcrum S1 of the center rocker arm 35, and the rotating direction of the rocker shaft 11 when the valve characteristics are varied from the high valve lift to the low valve lift are set in the same direction.

Figure 10:
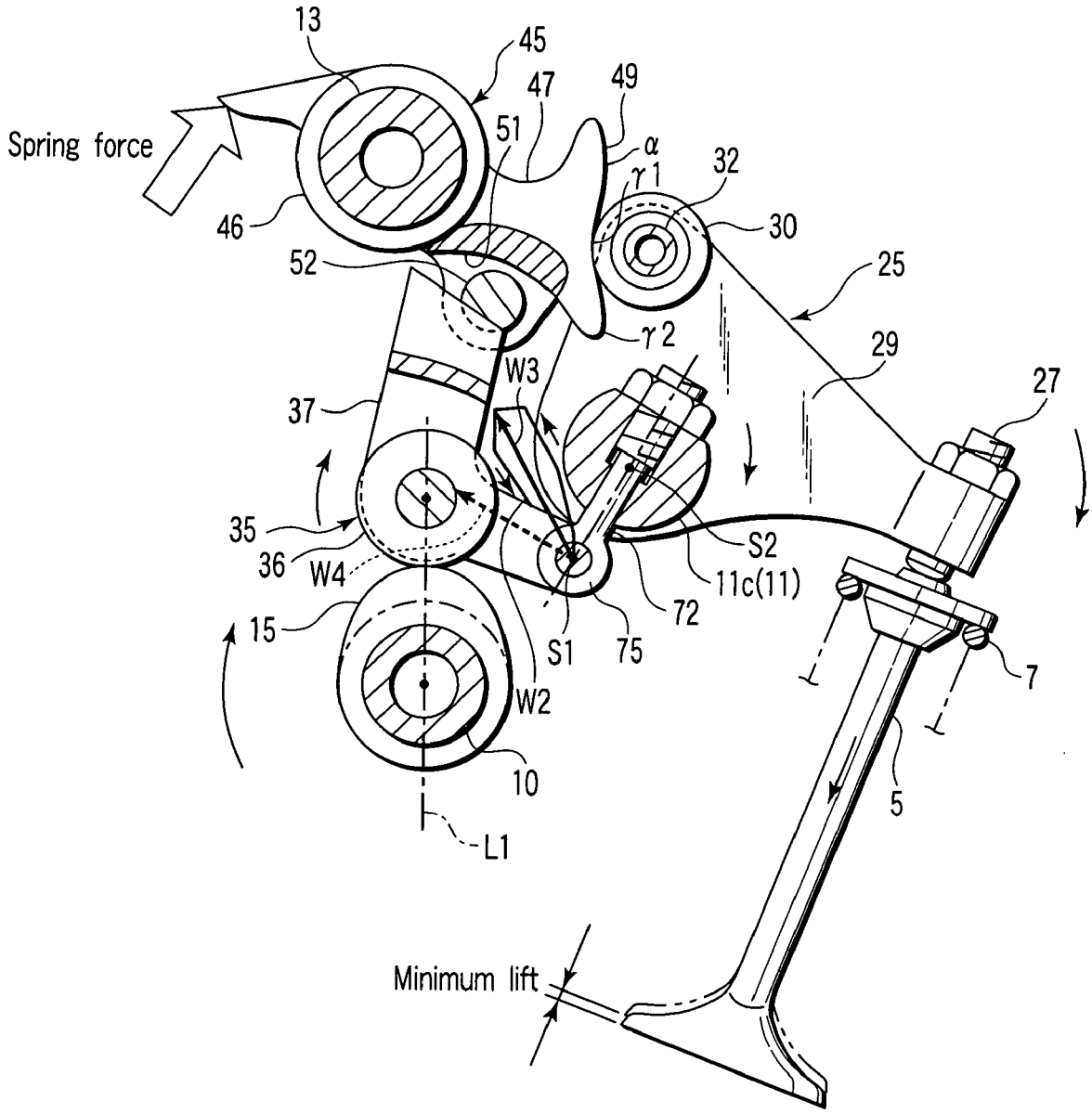
FIG. 10 is a view explaining behaviors of loads exerted on an oscillating fulcrum of a transmission arm at the time of low valve lift operation.

FIG. 10 shows a state in which the variable valve apparatus 20 is in the low valve lift volume. Note that, an example of the valve characteristics of the low valve lift volume is a valve characteristic of low valve lift—low rotating operation corresponding to the A5 shown in FIG. 9. In addition, an example of the valve characteristics of the middle valve lift volume is a valve characteristic of middle valve lift—middle rotating operation corresponding to the A4 shown in FIG. 9.

As shown in FIG. 10, a direction of a load W1 exerted on the oscillating fulcrum S1 when the swing cam 45 oscillates in the valve opening direction, and a direction of a load W2 exerted on the oscillating fulcrum S1 when the swing cam 45 oscillates in the valve closing direction are both se in the direction same as the rotating direction of the rocker shaft 11 when the rocker shaft 11 is changed from the high valve lift to the low valve lift as shown loci of the loads W1 and W2.

Figure 11:
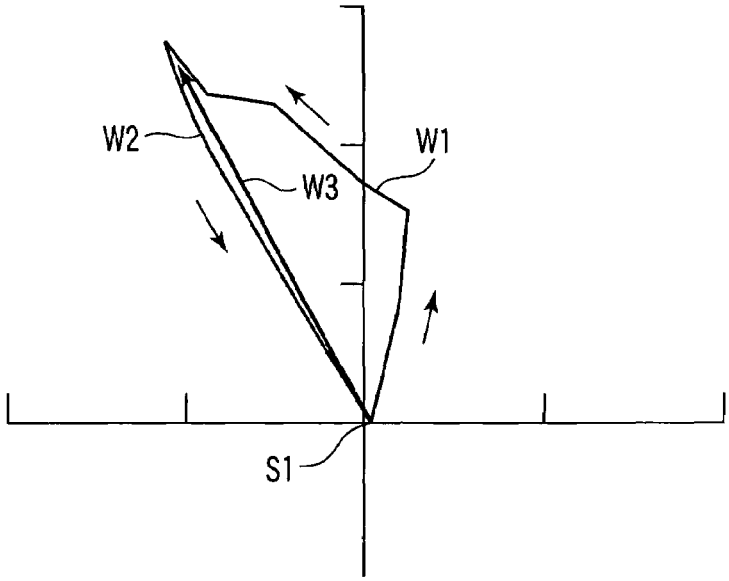
FIG. 11 is a diagram explaining behaviors of loads exerted on the oscillating fulcrum of the transmission arm at the time of middle valve lift operation.

As a consequence, as shown in FIGS. 10 and 11, a roll direction of a maximum load W3 generated on the oscillating fulcrum S1 when the swing cam 45 oscillates in the valve opening direction or when the swing cam 45 oscillating in the valve closing direction to the rocker shaft becomes clockwise, that is, same as the rotating direction of the rocker shaft 11 when the rocker shaft 11 is varied from the high valve lift to the low valve lift. A rotary torque generated by the maximum load W3 is set in order to rotate the rocker shaft 11 easily. A load W4 shown by the dotted line of FIG. 10 indicates a load component of the maximum load w3, which generates the rotary torque rotates the rocker shaft 11 in the counterclockwise of the rocker shaft 11 in the maximum load W3.

With the variable valve apparatus 20 the response when the rocker shaft 11 is varied from the high valve lift to the low valve lift in the intermediate valve lift region M can be improved.

About this point is described in detail with use a vehicle having the variable valve apparatus 20 as an example. The vehicle is assumed to be in the high rotation operation.

When the engine brake is generated in the vehicle which is in the high rotating speed, the throttle not shown is closed while the engine 100 maintains the high valve lift set in the high rotate operation for example the middle valve lift shown by the A4 in the FIG. 9. By the pump loss generated in this case, the effects of the engine brake are generated. Thereafter, engine rotation lowers due to the pump loss.

The rocker shaft 11 is immediately driven in the clockwise by the control motor 43, that is, an actuator from the high valve lift to the low valve lift, when the effect of the engine brake is canceled.

At this time, the posture of the line L2 is greatly tilted with respect to the line L1. Therefore, the maximum load generated during valve lift being exerted in the clockwise on the rocker shaft 11. That is, as shown in FIGS. 8 and 10, the rotary torque W4 whose direction is same as the rotating direction of the rocker shaft 11 during the rocker shaft 11 being varied from the high valve lift to the low valve lift is exerted to the rocker shaft 11. Consequently, the rocker shaft 11 can readily rotate in the direction in which the rocker shaft 11 is varied from the high valve lift side to the low valve lift side by the relevant rotary torque.

In particular, the maximum load generated when the swing cam 45 oscillates in the valve opening direction and the maximum load generated when the swing cam 45 oscillates in the valve closing direction are exerted as a rotary torque which goes from the high valve lift side to the low valve lift side. Accordingly, the rocker shaft 11 is still easier to rotate in the direction from the high valve lift side to the low valve lift side.

The rocker shaft 11 can readily rotate when the valve characteristics are varied from the high valve lift side to the low valve lift side by a rotary torque being provided to the rocker shaft 11. In other words, the control load which is applied on the control shaft 11 during a valve lift being changed from the high valve lift side to the low valve lift side is reduced. Consequently, the variable response during the control of the rocker shaft 11 from the high valve lift side to the low valve lift side can be improved.

On the contrary, when the valve characteristics are varied from the low valve lift side to the high valve lift side, it is enough that the rocker shaft 11 is rotated according to the acceleration. For this reason, the valve characteristics are varied for the required response even if the small capacity actuator, that is, small motor is used. As a result, light weight, compact size, and reduced energy consumption of the variable valve apparatus 20 as well as mountability of an internal combustion engine on vehicle can be achieved.

Figure 12:
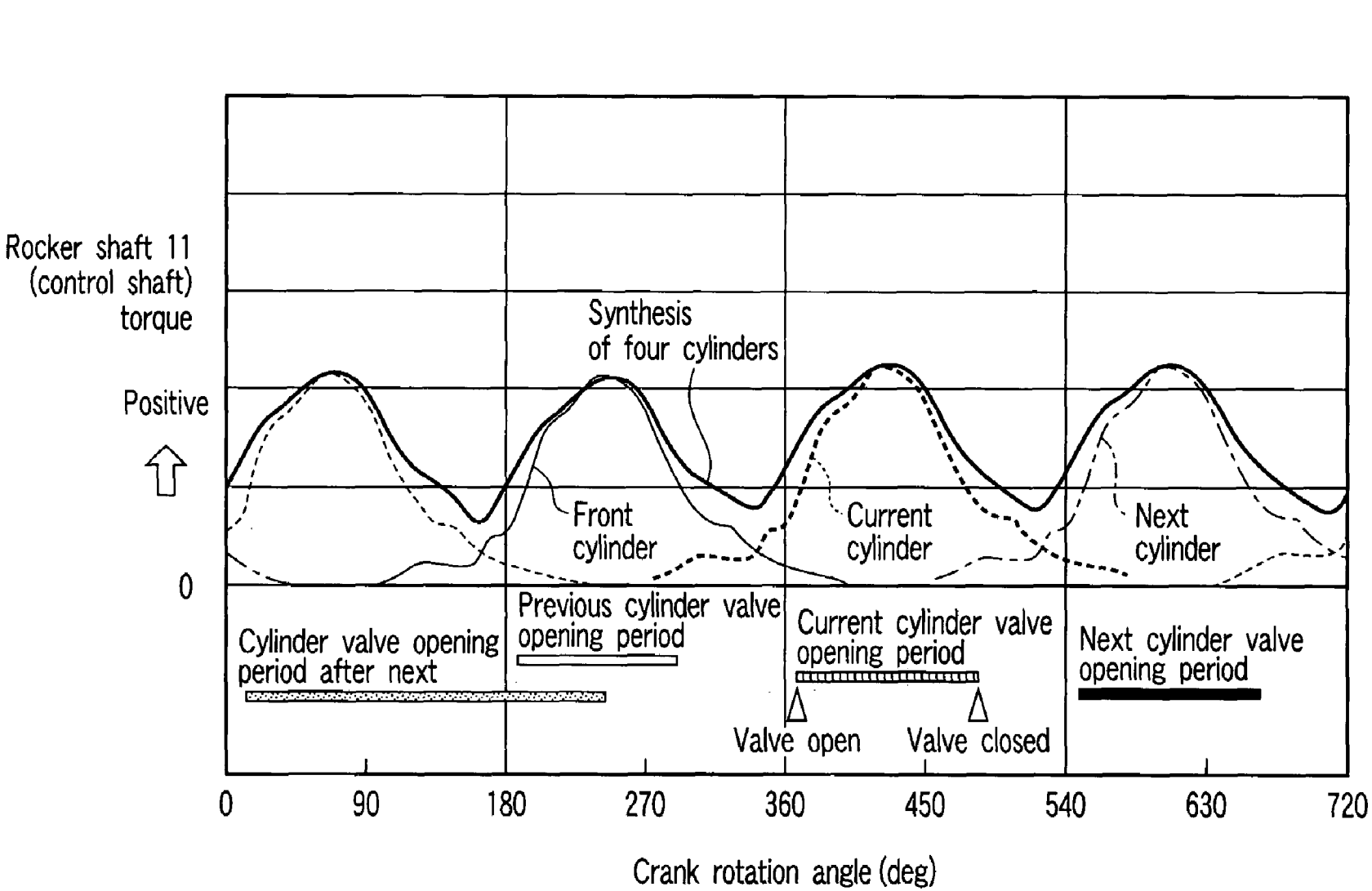
FIG. 12 is a graph showing a rotary torque generated in a control shaft at the time of "low valve lift and low rotating operation" of a four-cylinder engine.
Figure 13:
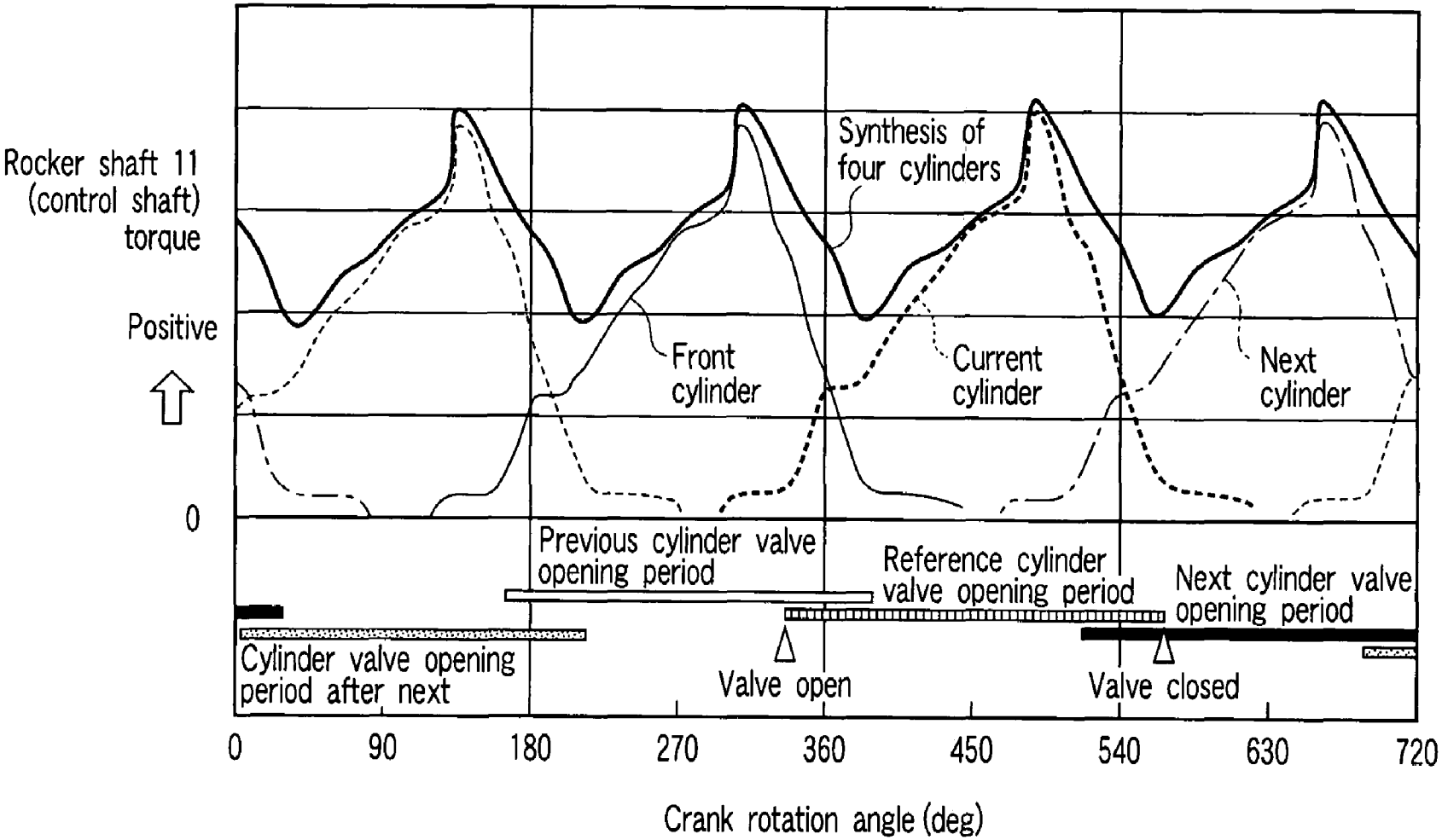
FIG. 13 is a graph showing a rotary torque generated in the control shaft at the time of "middle valve lift and middle rotating operation" of the four-cylinder engine.

In particular, even when for multi-cylinder engines, a structure is adopted to drive the variable valve apparatus 20 for each cylinder by using a common rocker shaft 11 (control shaft), the rotary torque generated around the rocker shaft 11, that is, the rotary torques for all cylinders (graphs shown by broken line, thin line, or alternate long and short dash line) are synthesized without being cancelled as shown in the thick line of the same figure and remain as shown in the graph of "at low valve lift—low rotating operation" shown in FIG. 12 and in the graph of "at middle valve lift—middle rotating operation" shown in FIG. 13, so that the characteristics of easy rotation are never lost.

Consequently, even in a multi-cylinder internal combustion engine, the response from the high valve lift side to the low valve lift side can be improved. Note that graphs of FIGS. 12 and 13 show the rotary torque generated in the rocker shaft 11 of a 4-cylinder engine. However, "positive" in the same figure indicates the torque of the rocker shaft 11 exerted clockwise and "negative" indicates the torque exerted counterclockwise in the same manner.

Now, with reference to FIGS. 14 and 15, a variable valve apparatus according to a second embodiment of the present invention will be described. Note that the configurations having the same functions as those in the first embodiment are denoted by the same reference numerals and the description thereof is not repeated.

In the present embodiment, it is difference that the variable valve apparatus 20 is provided at the exhaust side. Other structures may be the same as those in the first embodiment. The difference will be described in detail.

Figure 14:
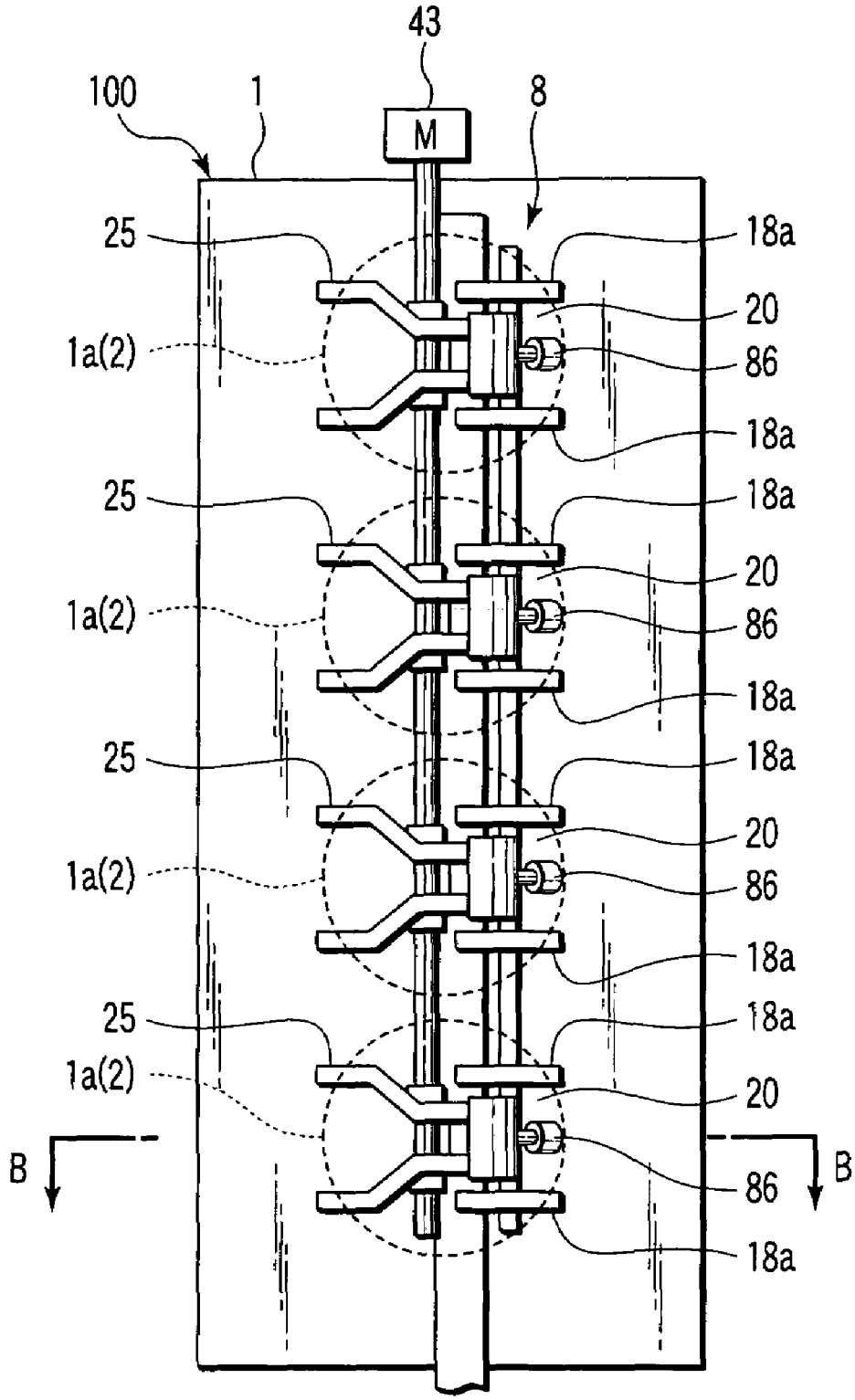
FIG. 14 is a plan view showing a cylinder head having, mounted on it, a variable valve apparatus according to a second embodiment of this present invention.

FIG. 14 is a plan view of a cylinder head 1 mounted the variable valve apparatus 20 according to this embodiment. FIG. 13 is a cross sectional view taken along line B-B shown in FIG. 14 of the cylinder head 1.

Figure 15:
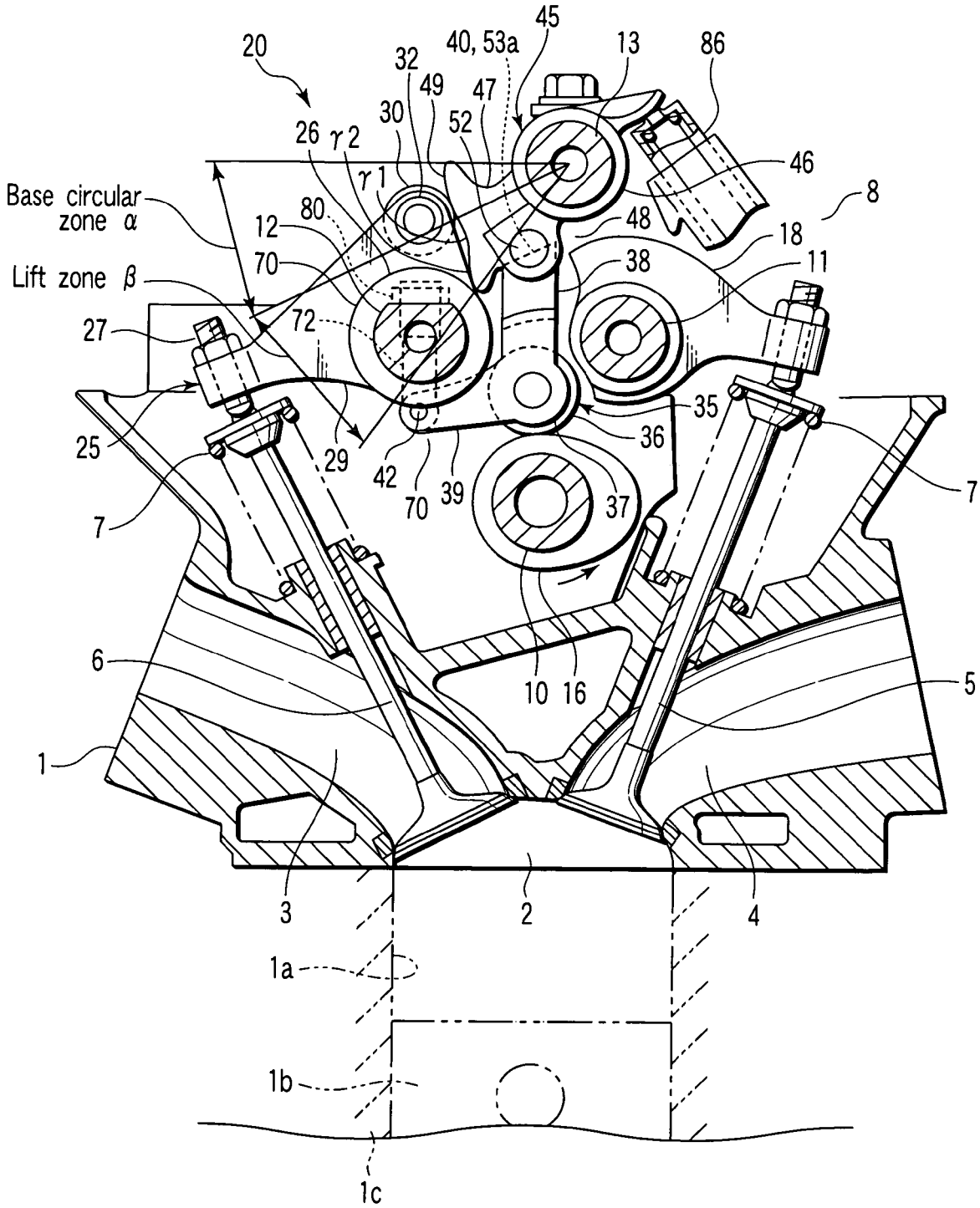
FIG. 15 is a cross sectional view taken along line B-B in FIG. 14 showing the variable valve apparatus and the cylinder head.

As shown in FIGS. 14 and 15, rocker shaft 12 of the exhaust side is provided in the variable valve apparatus 20 per the pair of the exhaust cam 16, that is, the pair of the exhaust valve 6. The a rocker arm 18*a* for the intake is rotatably supported by the rocker shaft 11 of the intake valve 15 per intake cam 15, that is intake valve 15.

The present embodiment can also provides the same advantageous effects as those provided by the first embodiment.

Note that the present invention is not limited to the first and second embodiments described above, and the present invention may be embodied in other specific forms without departing from the spirit or essential characteristics thereof. For example, in the above embodiment, the structure is employed in which the rocker shaft at the intake side is used also as the control shaft. However, a structure may be made in which a control shaft is employed separately.

Furthermore, in the first and second embodiments, the present invention is applied to an engine of an SOHC type valve operating system. A structure where the intake valve and the exhaust valve are driven by one camshaft is used for the SOHC type valve operating system. However, the present invention is not limited thereto, and the present invention may be applied to an engine of a Double Overhead Camshaft (DOHC) type valve operating system. A structure having a camshaft exclusive for the intake side and another camshaft exclusive for the exhaust side is used for the DOHC type valve operating system.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve apparatus of an internal combustion engine, comprising:

a cam shaft rotatably mounted to an internal combustion engine;

a cam formed in the cam shaft;

an oscillating cam swingably mounted to the internal combustion engine and having a cam surface which drives an intake valve or an exhaust valve;

a transmission arm which is interposed between the oscillating cam and the cam and which transmits displacement of the cam to the oscillating cam; and a control shaft which is rotatably mounted to the internal combustion engine, swingably supports the transmission arm, enables a position at which the transmission arm comes in contact with the cam to be changeable by the rotation displacement, and enables the valve characteristics of the intake valve or exhaust valve to be controllable by the position change, a direction of a maximum load generated with respect to the control shaft during valve lift at an oscillating fulcrum of the transmission arm and a rotating direction of the control shaft when the control shaft is varied from the high valve lift side to the low valve lift side are set in the same direction.

2. The variable valve apparatus of an internal combustion engine, according to claim 1, wherein a rotating direction of a maximum load around the center of axle of the control shaft generated at the oscillating fulcrum of the transmission arm when the oscillating cam oscillates in a valve opening direction, a rotating direction of a maximum load around the center of axle of the control shaft when the oscillating cam oscillates in a valve closing direction, and a rotating direction when the control shaft is varied from the high valve lift side to the low valve lift side are set in the same direction.

3. The variable valve apparatus of an internal combustion engine, according to claim 2, wherein the direction of the maximum load with respect to the control shaft generated during valve lift at the oscillating fulcrum of the transmission arm and the rotating direction when the control shaft is varied from the high valve lift side to the low valve lift side are set in the same direction in a state in which the valve characteristics are set in a middle valve lift region between a first lift state which is a low valve lift and a second lift state which is a high valve lift.

4. The variable valve apparatus of an internal combustion engine, according to claim 3, wherein the internal combustion engine has a plurality of cylinders, the oscillating cam and the transmission arm are installed for each one of the cylinders of the internal combustion engine, and the control shaft is configured by common shaft members which swingably support the transmission arms of at least two cylinders, respectively.

5. The variable valve apparatus of an internal combustion engine, according to claim 1, wherein the direction of the maximum load with respect to the control shaft generated during valve lift at the oscillating fulcrum of the transmission arm and the rotating direction when the control shaft is varied from the high valve lift side to the low valve lift side are set in the same direction in a state in which the valve characteristics are set in a middle valve lift region between a first lift state which is a low valve lift and a second lift state which is a high valve lift.

6. The variable valve apparatus of an internal combustion engine, according to claim 5, wherein the internal combustion engine has a plurality of cylinders, the oscillating cam and the transmission arm are installed for each one of the cylinders of the internal combustion engine, and the control shaft is configured by common shaft members which swingably support the transmission arms of at least two cylinders, respectively.

* * * * *